US010590574B2

(12) United States Patent
Kaing et al.

(10) Patent No.: US 10,590,574 B2
(45) Date of Patent: Mar. 17, 2020

(54) ABRASION RESISTANT BRAIDED TEXTILE SLEEVE AND METHOD OF CONSTRUCTION THEREOF

(71) Applicant: Federal-Mogul Powertrain, LLC, Southfield, MI (US)

(72) Inventors: Alice Kaing, Margny les Compiegne (FR); Patrick Thomas, Crepy-en-Valois (FR)

(73) Assignee: Federal-Mogul Powertrain LLC, Southfield, MI (US)

( * ) Notice: Subject to any disclaimer, the term of this patent is extended or adjusted under 35 U.S.C. 154(b) by 564 days.

(21) Appl. No.: 15/411,080

(22) Filed: Jan. 20, 2017

(65) Prior Publication Data

US 2017/0211215 A1 Jul. 27, 2017

Related U.S. Application Data

(60) Provisional application No. 62/286,106, filed on Jan. 22, 2016, provisional application No. 62/408,962, filed on Oct. 17, 2016.

(51) Int. Cl.
*D04C 1/06* (2006.01)
*D04C 1/02* (2006.01)

(52) U.S. Cl.
CPC ..... *D04C 1/06* (2013.01); *D04C 1/02* (2013.01); *D10B 2505/12* (2013.01)

(58) Field of Classification Search
CPC ..... D04C 1/02; D04C 1/06
See application file for complete search history.

(56) References Cited

U.S. PATENT DOCUMENTS

| | | | | |
|---|---|---|---|---|
| 4,836,080 | A | 6/1989 | Kite, III et al. | |
| 4,989,422 | A | 2/1991 | Barlow et al. | |
| 5,197,370 | A | 3/1993 | Gladfelter | |
| 7,074,470 | B2 | 7/2006 | Niwa | |
| 7,797,919 | B2 * | 9/2010 | Kirth | D07B 1/02 57/210 |
| 8,910,554 | B2 | 12/2014 | Kinugasa | |
| 9,394,636 | B2 * | 7/2016 | Gao | F16L 57/06 |

(Continued)

FOREIGN PATENT DOCUMENTS

| | | | |
|---|---|---|---|
| EP | 1422728 | A2 | 5/2004 |
| WO | 9014455 | A1 | 11/1990 |

OTHER PUBLICATIONS

International Search Report, dated Jul. 12, 2017 (PCT/US2017/014485).

*Primary Examiner* — Shaun R Hurley
(74) *Attorney, Agent, or Firm* — Robert L. Stearns; Dickinson Wright, PLLC

(57) ABSTRACT

A protective textile sleeve and method of construction thereof is provided. The sleeve has a flexible, tubular wall of braided yarns. At least some of the yarns are provided as a plurality of monofilaments and at least some of the yarns are provided as a plurality of multifilaments. The plurality of multifilaments are braided in a plurality of separate bundles. Each of the bundles includes at least two multifilaments. The monofilaments are embedded into the multifilaments during the braiding process to lock the multifilaments in an "as braided" location to prevent shifting of the multifilaments during application and during use, thereby enhancing the abrasion resistance of the sleeve wall.

21 Claims, 4 Drawing Sheets

(56) References Cited

U.S. PATENT DOCUMENTS

| | | | | |
|---|---|---|---|---|
| 10,167,582 | B1 * | 1/2019 | Pilgeram | D04C 3/48 |
| 2004/0091655 | A1 | 5/2004 | Niwa | |
| 2004/0109965 | A1 | 6/2004 | Klinklin | |
| 2010/0108171 | A1 * | 5/2010 | Relats Manent | F16L 57/04<br>138/125 |
| 2010/0274282 | A1 * | 10/2010 | Olson | A61L 17/04<br>606/228 |
| 2014/0220276 | A1 | 8/2014 | Gao et al. | |

* cited by examiner

| A | B | C | D | E | F |
|---|---|---|---|---|---|
| Sample | Size | 36 carriers: assembly 2 ends Diolen®1100 Dtex | 36 carriers: 1 end Mono filament PA 0.38 black | Mass (g/m) | Density (g/m2) |
| **1** | **4mm** | 16 carriers: 2 ends Diolen®1100 Dtex | 16 carriers: 1 ends Mono filament PA 0.38 black | 7.8 | 621.7 |
| **2** | **5mm** | 16 carriers: 2 ends Diolen®1100 Dtex | 16 carriers: 1 end Mono filament PA 0.38 black | 8.5 | 541.5 |
| **3** | **6mm** | 24 carriers: 2 ends Diolen®1100 Dtex | 24 carriers: 1 end Mono filament PA 0.38 black | 11.1 | 588.5 |
| **4** | **8mm** | 36 carriers: 2 ends Diolen®1100 Dtex | 36 carriers: 1 end | 17.4 | 693.6 |
| **5** | **10mm** | 36 carriers: 2 ends Diolen®1100 Dtex | 36 carriers: 1 end Mono filament PA 0.38 black | 17.3 | 551.4 |
| **6** | **12mm** | 36 carriers: 2 ends Diolen®1100 Dtex | 36 carriers: 1 end Mono filament PA 0.38 black | 17.6 | 466.9 |

FIG. 6

ABRASION RESISTANT BRAIDED TEXTILE SLEEVE AND METHOD OF CONSTRUCTION THEREOF

CROSS-REFERENCE TO RELATED APPLICATION

This application claims the benefit of U.S. Provisional Application Ser. No. 62/408,962, filed Oct. 17, 2016, and also U.S. Provisional Application Ser. No. 62/286,106, filed Jan. 22, 2016, which are both incorporated herein by way of reference in their entirety.

BACKGROUND OF THE INVENTION

1. Technical Field

This invention relates generally to textile sleeves for protecting elongate members, and more particularly to braided textile sleeves.

2. Related Art

Tubular textile sleeves are known for use to provide protection to internally contained elongate members, such as wire harnesses, fluid or gas conveying tubes, or cables, for example. It is further known to braid tubular textile sleeves for protecting elongate members contained therein. Modern vehicle applications for such sleeves are requiring greater protection to the elongate members, such as against increased environmental temperatures and increased resistance to abrasion. These increased demands require the sleeves to pass various test parameters, such as exposure to increased temperatures and exposure to specifically defined abrasion test specifications, such as abrasion tools being passed along both the length of the sleeve and transversely to the length of the sleeve without abrading through the full braided layer of the sleeve or causing any damage to the elongate member contained therein. Known braided sleeve constructions, under some test parameters, are unable to meet the test specifications, and thus, further development is needed. Of course, it is to be appreciated that the resulting sleeves must not only meet the various thermal and abrasion resistant test requirements, but also must be economical in manufacture; have a relatively small envelope and remain flexible to facilitate installation over meandering paths, which tend to be contrary to the ability to form a sleeve that meets increasingly stringent test parameters.

A braided sleeve constructed in accordance with this invention is able to meet the increasingly demanding temperature and abrasion resistant test parameters discussed above, while also having a relatively small envelope and remaining flexible, while other benefits may become readily recognized by those possessing ordinary skill in the art.

SUMMARY OF THE INVENTION

A textile sleeve having a seamless, flexible, abrasion resistant tubular wall of braided yarns is provided. The yarns of the wall are braided to withstand elevated temperatures, such as up to about 175° C., and to resist abrasion through the full wall thickness under specified test parameters, while also remaining sufficiently flexible such that the sleeve can be routed about meandering paths including sharp bends without kinking.

In accordance with another aspect of the invention, a protective textile sleeve is provided having a flexible, tubular wall of braided yarns. At least some of the yarns are provided as a plurality of monofilaments and at least some of the yarns are provided as a plurality of multifilaments. The plurality of multifilaments are braided in a plurality of separate bundles. Each of the bundles includes at least two multifilaments, wherein the flexible, tubular wall has an outer surface density of between about 500-700 g/m$^2$.

In accordance with another aspect of the invention, the multifilaments have a denier of between about 1000-1200 dTex.

In accordance with another aspect of the invention, the multifilaments have a tenacity between about 60-85 cN/tex.

In accordance with another aspect of the invention, the multifilaments are polyester.

In accordance with another aspect of the invention, the monofilaments have a diameter between about 0.35-0.40 mm.

In accordance with another aspect of the invention, the monofilaments have a tenacity between about 40-55 cN/tex.

In accordance with another aspect of the invention, the monofilaments have a Young's Modulus of about 3 GPa.

In accordance with another aspect of the invention, the plurality of multifilaments and the plurality of monofilaments are braided in a respective ratio of about 2:1.

A protective textile sleeve constructed in accordance with another aspect of the invention has a flexible, tubular wall of braided yarns, with at least some of the yarns being provided as a plurality of monofilaments and at least some of the yarns being provided as a plurality of multifilaments. The plurality of multifilaments are braided as a plurality of separate bundles, with each of the bundles including at least two multifilaments. Further, the monofilaments have a tenacity between about 40-55 cN/tex, thereby being embedded into the multifilaments to lock the multifilaments in an "as braided" location to enhance the abrasion resistance of the sleeve wall.

A protective textile sleeve constructed in accordance with another aspect of the invention has a flexible, tubular wall of braided yarns, with at least some of the yarns being provided as a plurality of monofilaments and at least some of the yarns being provided as a plurality of multifilaments. The plurality of multifilaments are braided in a plurality of separate bundles, with each of the bundles including at least two multifilaments, wherein the monofilaments have a Young's Modulus of about 3 GPa, thereby being embedded into the multifilaments to lock the multifilaments in an "as braided" location to enhance the abrasion resistance of the sleeve wall.

In accordance with another aspect of the invention, a method of constructing a protective textile sleeve is provided. The method includes braiding a flexible, tubular wall from a plurality of monofilaments having a tenacity between about 40-55 cN/tex and a plurality of multifilaments having a denier of between about 1000-1200 dTex. The plurality of multifilaments are braided as a plurality of separate bundles, with each of the separate bundles including at least two multifilaments. The method includes embedding the plurality of monofilaments into the plurality of multifilaments during the braiding process to effectively lock the plurality of multifilaments in place.

In accordance with another aspect of the invention, the method further includes providing the multifilaments having a tenacity between about 60-85 cN/tex.

In accordance with another aspect of the invention, the method further includes providing the monofilaments having a diameter between about 0.35-0.40 mm.

In accordance with another aspect of the invention, the method further includes providing the monofilaments having a Young's Modulus of about 3 GPa.

BRIEF DESCRIPTION OF THE DRAWINGS

These and other aspects, features and advantages of the invention will become readily apparent to those skilled in the art in view of the following detailed description of the presently preferred embodiments and best mode, appended claims, and accompanying drawings, in which:

FIG. 6 is a table listing different braid sleeve structures constructed in accordance with various aspects of the invention.

DETAILED DESCRIPTION OF PREFERRED EMBODIMENTS

Figure 1:
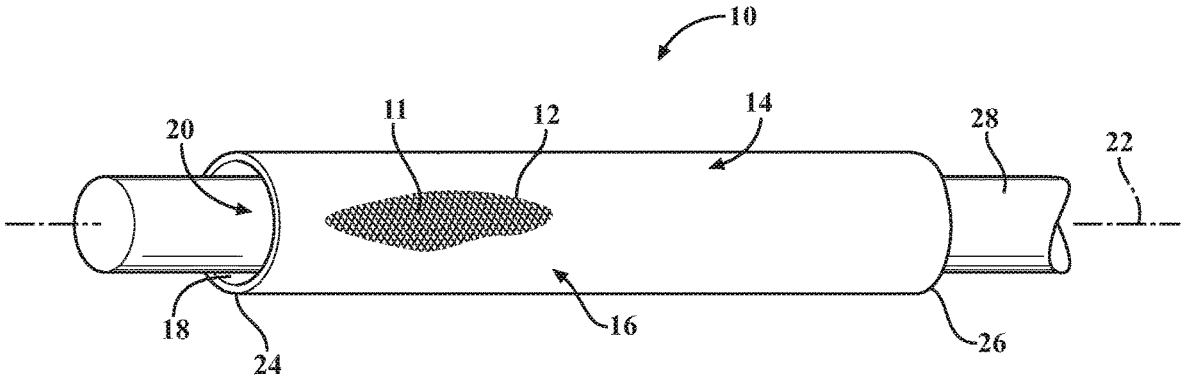
FIG. 1 is a schematic perspective view of a braided protective textile sleeve constructed in accordance with one aspect of the invention shown protecting an elongate member extending therethrough.
Figure 2:
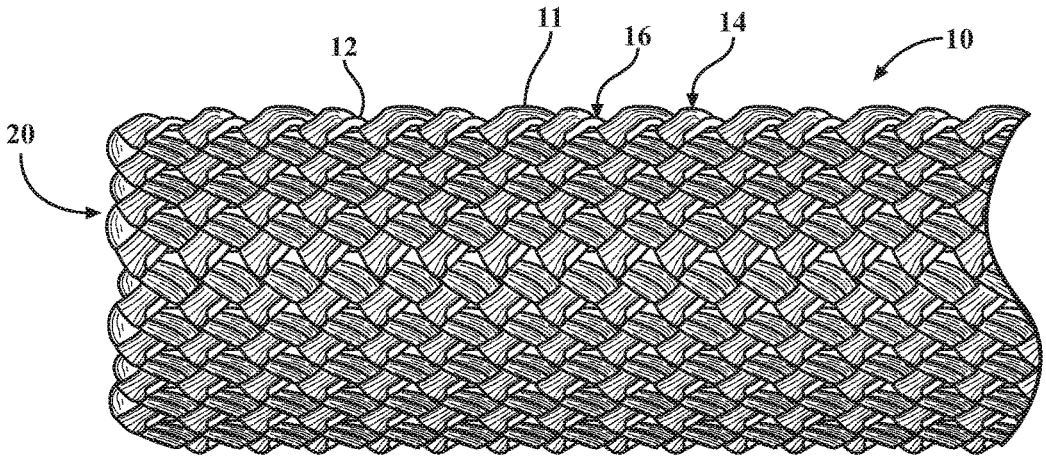
FIG. 2 is an enlarged fragmentary plan view of a wall of the sleeve of FIG. 1.
Figure 4:
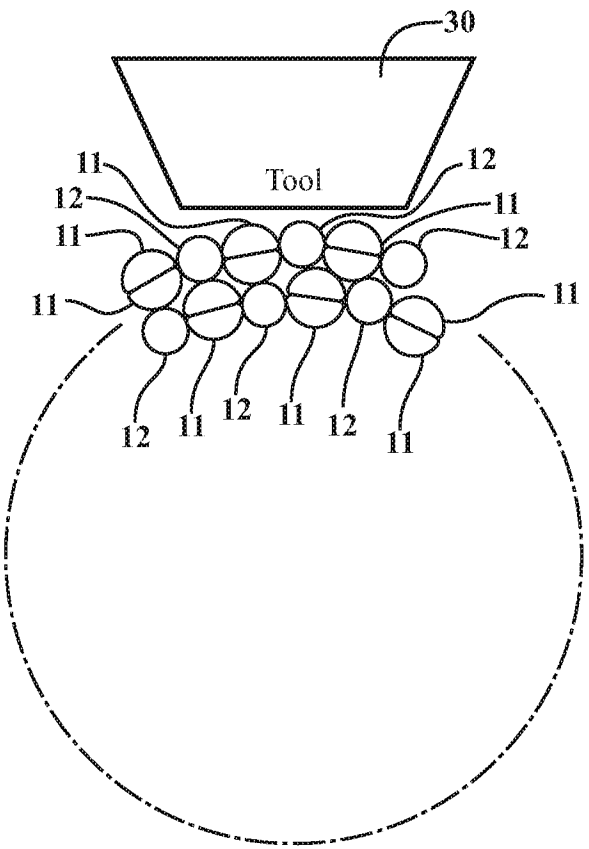
FIG. 4 is a schematic partial end view illustrating a braid structure of the sleeve of FIG. 1 with an abrasion test tool arranged for contact therewith.

Referring in more detail to the drawings, FIG. 1 illustrates a braided tubular textile sleeve 10 constructed according to one aspect of the invention. The sleeve 10 includes a plurality of multifilament yarns, referred to hereafter as simply as multifilaments 11, braided with a plurality of monofilament yarns, referred to hereafter simply as monofilaments 12, to form a tubular wall 14 of the sleeve 10. The wall 14 is braided in seamless fashion and thus, has a circumferentially continuous, uninterrupted outer surface 16 and an inner surface 18 defining an inner tubular cavity 20 extending axially along a central longitudinal axis 22 between opposite ends 24, 26 of the sleeve 10. The cavity 20 is sized for receipt of an elongate member 28 to be protected, such as a wire harness, fluid or gas conveying conduit, cable or the like. The synergies created between the multifilaments 11 and the monofilaments 12 provide the sleeve 10 with an outer surface density as low as about 500 g/m$^2$, resulting in a cost effective sleeve and a highly flexible wall 14, while at the same time providing the wall 14 with a tough outer surface 16 that is highly resistant to abrasion, such that the wall 14 of the sleeve 10 is able to protect the elongate member 28 contained therein against damage. Evidence of such toughness under elevated temperatures has been empirically verified in abrasion testing, discussed in more detail below.

Figure 3:
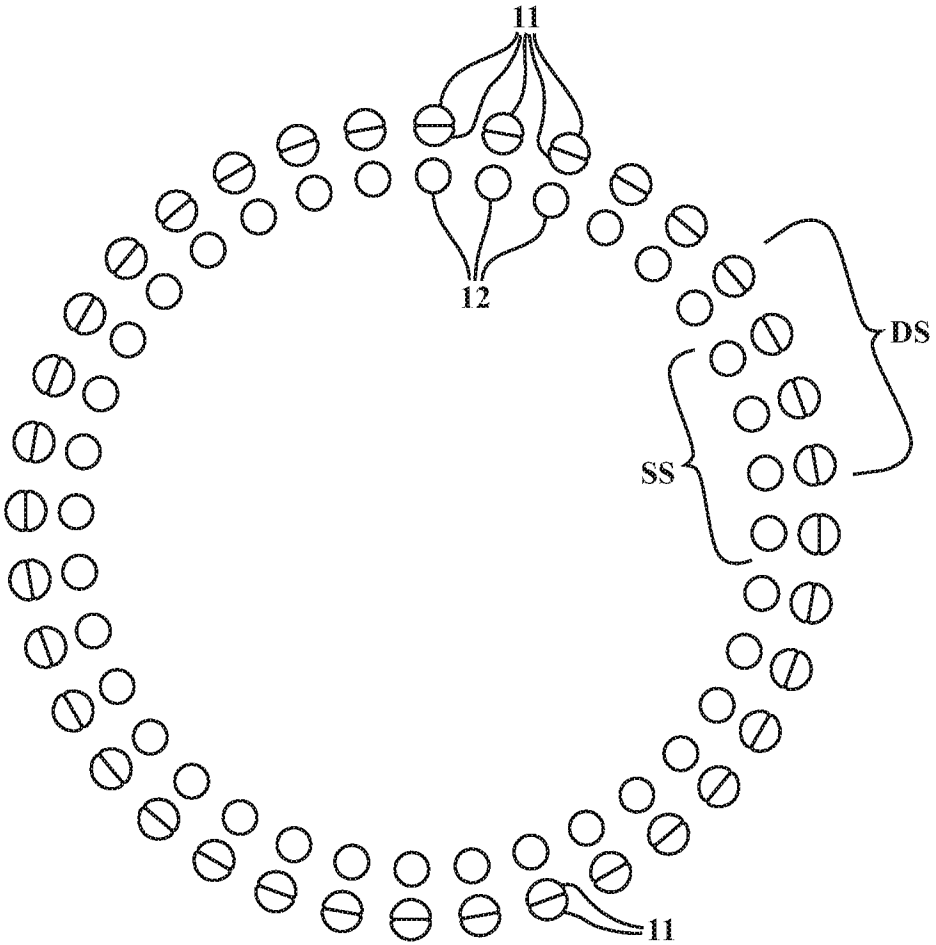
FIG. 3 is a schematic end view illustrating a braid structure of the sleeve of FIG. 1 depicting a ratio of bundled multifilaments and individual monofilaments.

The wall 14 can be constructed having any suitable length and diameter and is braided having a tight braid structure to increase the impermeability of the wall 14 against the ingress of external fluid and/or debris into the cavity 20 without need for a secondary coating of any kind. Accordingly, the sleeve 10 is made cost effective given its ability to provide protection to the elongate member 28 without need for multiple wall layers or a secondary coating material. In accordance with one aspect of the invention, the wall 14 is formed with bundled, dual strands or ends of the multifilaments 11 in side-by-side, mirrored relation and with single strands or ends of the monofilaments 12, wherein the bundled multifilaments 11 are braided with the single monofilament strands 12. FIG. 3 illustrates the individual bundles of dual strands DS of multifilaments 11, shown schematically, in relation to the single strands SS of monofilaments 12, shown schematically. As such, if an equal number of carriers are used to braid the wall 14, such as 36 carriers for the multifilaments 11 and 36 carriers for the monofilaments 12, by way of example and without limitation, each of the carriers of the multifilaments 11 has 2 ends of the multifilaments 11, while each of the carriers of the monofilaments 12 has a single end of the monofilaments 12. Accordingly, the multifilaments 11 and monofilaments 12 are braided with one another in a respective ratio of 2:1 ends. As such, it should be recognized the two ends of multifilaments 11 on each carrier are braided in side-by-side, mirrored relation with one another as though they are a single, common yarn.

The monofilaments 12 play in important role in the performance of the sleeve 10 and provide the sleeve 10 with its ability to resist abrasion, and function in part to lock the bundled multifilaments 11 in their "as braided" location during use, thereby enhancing the abrasion resistance of the wall 14 provided by the "locked and fixed" high tenacity multifilaments 11. The multifilaments of polyester are provided having a linear density of between about 1000-1200 dTex, and in one exemplary embodiment were provided having an 1100 denier and a count-related yarn tenacity between about 60-85 cN/tex, wherein cN/tex yarn=cN/tex fiber(×)substance utilization %(/)100, and in particular, were provided as high tenacity PET sold under the tradename Diolen®, by way of example and without limitation. The ability of the monofilaments 12 to lock the multifilaments 11 in position is due in part to the diameter of the monofilaments, which is provided between about 0.35-0.40 mm, and also the high modulus and rigidity in the radial direction (lack of ability to be radially deformed elastically) of the monofilaments (it is to be understood that although the monofilaments 112 are rigid in the radial direction that they remain flexible along their length, thereby allowing the sleeve 10 to remain highly flexible), having a relatively high Young's Modulus of elasticity, such as about 3 GPa, and a tenacity between about 40-55 cN/tex, and in one particularly preferred embodiment, by way of example and without limitation, high tenacity thermoplastic polyamide, such as high tenacity nylon. With the monofilaments 12 having a relatively high Young's Modulus, they are able to be embedded into the multifilaments 11, thereby acting to lock the multifilaments 11 in place in an "as braided" location. To the contrary, if the monofilaments were provided having a relatively low Young's Modulus, the monofilaments would be more elastic, both axially and radially, and as such, would not be embedded into the multifilaments to the degree needed to lock the multifilaments in an "as braided" location. As such, with a relatively low Young's Modulus monofilament, an increased surface area density of the wall would be needed, such as about 900 g/m$^2$, to provide the degree of abrasion resistance needed to pass the abrasion test and to protect the elongate member against damage. Of course, it should be recognized that an increased surface area would come at an increased cost, add bulk, and further, would reduce the flexibility of the sleeve.

Figure 5A:
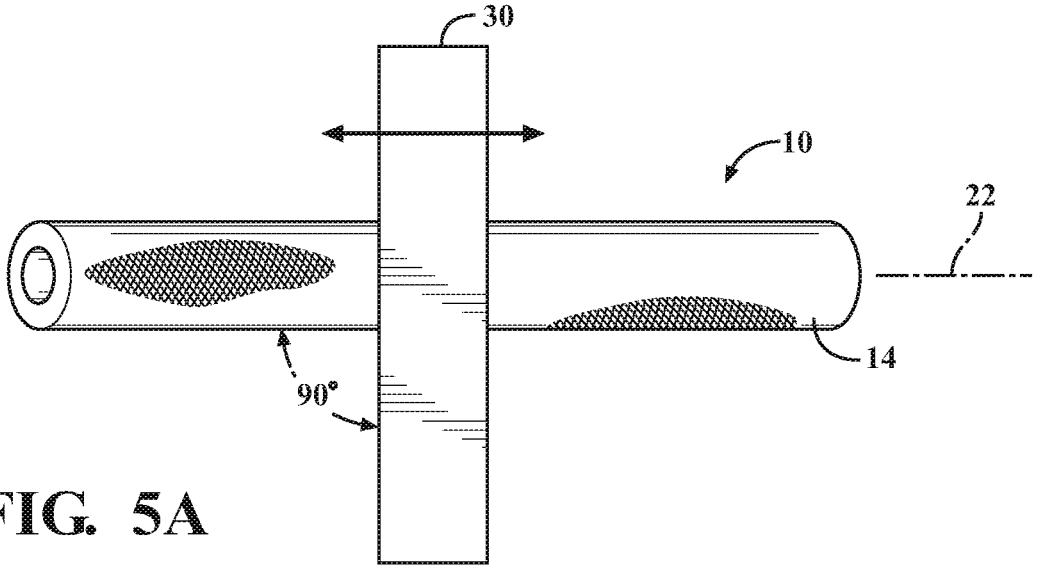
FIGS. 5A and 5B illustrate abrasion tests performed on a sleeve to determine if the sleeve meets predetermined specification requirements.
Figure 5B:
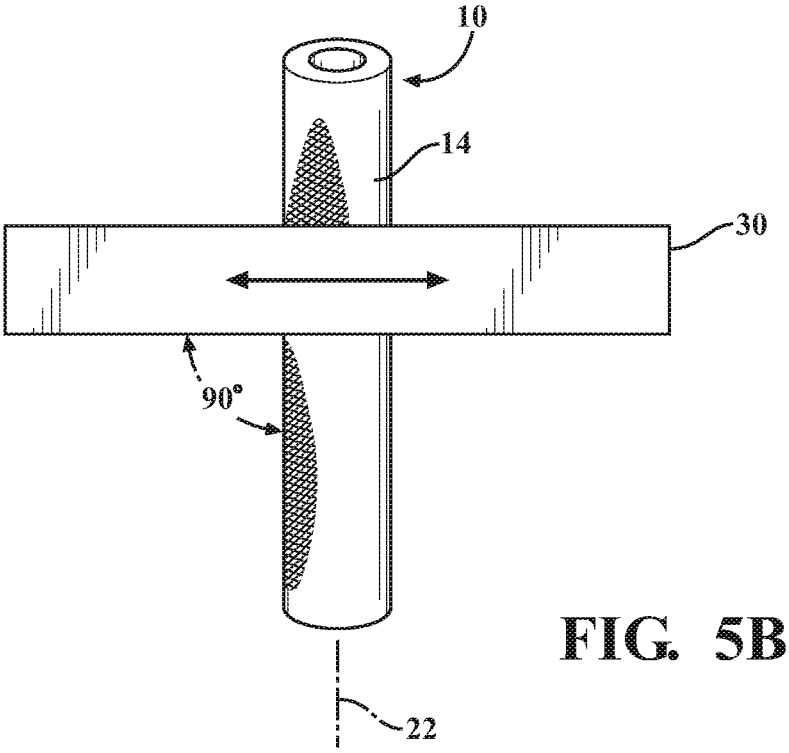

Tests used to validate the abrasion resistance of the sleeve 10 include a tool 30, having an applied mass of 200 g, that is oriented with the length of the tool 30 extending generally transversely to the longitudinal axis 22 of the sleeve 10 (5A and 5B). In accordance with one test, the tool 30 is moved along the length of the sleeve 10 at a frequency of 10 Hz, such as shown in FIG. 5A, and in another test, the tool 30 is moved at a frequency of 10 Hz in a sawing type motion, transversely to the length of the sleeve, across the width of the sleeve 10, such as shown in FIG. 5B. The number of cycles for a new sleeve test is 144,000. A sleeve 10 constructed in accordance with the invention, as described above, is able to pass the test having a rating of 4 or higher on a scale of 0-5. Passing the test requires only a partial wearing of the underlying braided yarns take place during testing, without breaking through the thickness or severing of any of the underlying braided yarns, and of course, no damage to an elongate member contained in the sleeve 10 can result. The abrasion resistance test procedure performed on a sleeve constructed in accordance with the invention, which passed the test with a score of no less than 4, is as follows:

Test #1: Abrasion resistance per D44 1959, category D per S21 5101 Procedure: The following was performed on a minimum of 3 samples per abrasion direction:

A sample was cut to a length of approximately 100 mm.

The sample was installed over a PA hose of the nominal sleeve size and a steel mandrel was inserted inside the hose.

The assembly sample/hose/mandrel was mounted on the sample holder.

The abrasive tool, Category D (PA66GF30 plastic edge), was mounted on the tool holder such that the angle tool/sample was 90°.

The contact tool/sample was created applying a mass of 200 g.

The oven was pre-heated at 120° C. before testing.

After stabilization of the oven temperature, the test was launched.

After 144,000 cycles (4 hours) of abrasion test at 10 cycles/sec (stroke of 10 mm), per longitudinal (type A or grating) and transverse (type B or sawing) directions, The sample was visually inspected for grading from 0 to 5.

During construction of the sleeve 10, including braiding the bundled multifilaments 11 and single monofilaments 12 with one another, as discussed above, the desired length of the sleeve 10 is preferably cut to length in the braiding process. Cutting the desired finished length of the sleeve 10 in the braiding process has been found to facilitate maintaining the round outer peripheral shape of the sleeve 10, thereby facilitating insertion of the elongate member 28 through the cavity 20.

The table illustrated in FIG. 6 shows six (6) different samples produced in accordance with various aspects of the invention, by way of example and without limitation, with the mean sleeve diameter listed in column B; the various types of multifilament and monofilament yarns listed in columns C and D, respectively, along with the number of carriers and ends of respective yarns; the braid wall mass listed in column E; and the braid wall density listed in column F.

It is to be understood that the above detailed description is with regard to some presently preferred embodiments, and that other embodiments readily discernible from the disclosure herein by those having ordinary skill in the art are incorporated herein and considered to be within the scope of any ultimately allowed claims.

What is claimed is:

1. A protective textile sleeve, comprising:

a flexible, tubular wall of braided yarns, at least some of said yarns being provided as monofilaments and at least some of said yarns being provided as multifilaments, said multifilaments being braided in a plurality of separate bundles, each of said bundles including at least two multifilaments, wherein said flexible, tubular wall has an outer surface density of between 500-700 g/m$^2$.

2. The protective textile sleeve of claim 1, wherein each of said multifilaments has a denier of between 1000-1200 dTex.

3. The protective textile sleeve of claim 2, wherein each of said multifilaments has a tenacity between 60-85 cN/tex.

4. The protective textile sleeve of claim 3, wherein said multifilaments are polyester.

5. The protective textile sleeve of claim 2, wherein said monofilaments have a diameter between 0.35-0.40 mm.

6. The protective textile sleeve of claim 1, wherein said monofilaments have a tenacity between 40-55 cN/tex.

7. The protective textile sleeve of claim 1, wherein said monofilaments have a Young's Modulus of 3 GPa.

8. The protective textile sleeve of claim 1, wherein said multifilaments and said monofilaments are provided in a respective ratio of 2:1.

9. A protective textile sleeve, comprising:

a flexible, tubular wall of braided yarns, at least some of said yarns being provided as monofilaments and at least some of said yarns being provided as multifilaments, said multifilaments being braided in a plurality of separate bundles, each of said bundles including at least two multifilaments, wherein said monofilaments have a tenacity between 40-55 cN/tex.

10. The protective textile sleeve of claim 9, wherein each of said multifilaments has a denier of between 1000-1200 dTex.

11. The protective textile sleeve of claim 9, wherein each of said multifilaments has a tenacity between 60-85 cN/tex.

12. The protective textile sleeve of claim 9, wherein said monofilaments have a diameter between 0.35-0.40 mm.

13. The protective textile sleeve of claim 9, wherein said monofilaments have a Young's Modulus of 3 GPa.

14. A protective textile sleeve, comprising:

a flexible, tubular wall of braided yarns, at least some of said yarns being provided as monofilaments and at least some of said yarns being provided as multifilaments, said multifilaments being braided in a plurality of separate bundles, each of said bundles including at least two multifilaments, wherein said monofilaments have a Young's Modulus of 3 GPa.

15. The protective textile sleeve of claim 14, wherein each of said multifilaments has a denier of between 1000-1200 dTex.

16. The protective textile sleeve of claim 14, wherein each of said multifilaments has a tenacity between 60-85 cN/tex.

17. The protective textile sleeve of claim 14, wherein said monofilaments have a diameter between 0.35-0.40 mm.

18. A method of constructing a protective textile sleeve, comprising:

braiding a flexible, tubular wall from monofilaments having a tenacity between 40-55 cN/tex and multifilaments each having a denier of between 1000-1200 dTex, with the multifilaments being braided as a plurality of separate bundles, with each of the separate bundles including at least two multifilaments, and embedding the monofilaments into the multifilaments during the braiding process to effectively lock the multifilaments in place.

19. The method of claim 18, further including providing the multifilaments each having a tenacity between 60-85 cN/tex.

20. The method of claim 18, further including providing the monofilaments having a diameter between 0.35-0.40 mm.

21. The method of claim 18, further including providing the monofilaments having a Young's Modulus of 3 GPa.

* * * * *